US006176573B1

(12) United States Patent
Barth et al.

(10) Patent No.: US 6,176,573 B1
(45) Date of Patent: Jan. 23, 2001

(54) GAS-FLOW MANAGEMENT USING CAPILLARY CAPTURE AND THERMAL RELEASE

(75) Inventors: Phillip W. Barth, Portola Valley; William H. McAllister, Saratoga; Storrs Hoen, Brisbane; Karen C. Cheung, San Jose, all of CA (US)

(73) Assignee: Agilent Technologies Inc., Palo Alto, CA (US)

( * ) Notice: Under 35 U.S.C. 154(b), the term of this patent shall be extended for 0 days.

(21) Appl. No.: 09/440,834

(22) Filed: Nov. 15, 1999

(51) Int. Cl.[7] ..... B41J 2/19
(52) U.S. Cl. ..... 347/92
(58) Field of Search ..... 347/86, 87, 88, 347/92, 93

(56) References Cited

U.S. PATENT DOCUMENTS 4,931,811 6/1990 Cowger et al. ..... 347/87
4,931,812 6/1990 Dunn et al. ..... 347/87
5,621,444 4/1997 Beeson ..... 347/88
6,007,193 * 12/1999 Kashimura et al. ..... 347/92

* cited by examiner

*Primary Examiner*—N. Le
*Assistant Examiner*—Anh T. N. Vo

(57) ABSTRACT

A control device for regulating the flow of gas through a liquid utilizes capillary forces to manage gas retention and utilizes thermal energy to execute a gas release operation. A capillary path within the control device has an opening to a reservoir of liquid and has a geometry by which gas flow is inhibited by capillary forces on a liquid volume within the path. An equilibrium condition is established at the interface of the liquid and gas. However, a heater is in thermal communication with the capillary path for selectively heating the contained volume of liquid sufficiently to free the flow of air through the path. In a preferred application, the control device is employed in an ink cartridge to release accumulated air at selected times. By heating ink within the capillary path to a temperature above the boiling point of ink, the equilibrium condition at the air-to-ink interface is overcome. In addition to the capillary path, there preferably is a liquid-fill maintenance path that ensures that the capillary path is refilled following each release operation.

21 Claims, 10 Drawing Sheets

GAS-FLOW MANAGEMENT USING CAPILLARY CAPTURE AND THERMAL RELEASE

TECHNICAL FIELD

The invention relates generally to devices and methods for controlling gas flow through a liquid and more particularly to air flow management within a liquid container, such as an inkjet cartridge.

BACKGROUND ART

Valving mechanisms may be used to control the flow of gas through a liquid. Such valving mechanisms are employed in systems which require a precisely timed release of gas in order to cause the gas to perform work or in order to provide a desired gaseous state within the environment in which the gas is released. Alternatively, the valving mechanism may be used to retain the gas until a time when the effects of the release will be minimal. A gas management valving mechanism may be a large scale device or may be formed using micromachining techniques, depending upon the desired application.

Air management is desirable in inkjet printing to prevent inkjet cartridges from "depriming" due to the accumulation of an air bubble in the ink flow path. Air bubble accumulation is a particular worry near a thermal inkjet printing head, which typically comprises a silicon chip containing an array of heating resistors which boil ink and expel it, through an array of orifices adjacent to the resistors and onto nearby paper. The ink to be expelled is typically at a small negative pressure with respect to atmosphere to prevent it from drooling out of the orifices, but too large a negative pressure can suck air in through the orifices, forming bubbles in the ink. In addition, heat from the boiling of the ink causes air dissolved in the ink to outgas and form small bubbles. These bubbles may coalesce in the ink over the silicon chip to form large bubbles which can impede ink flow, causing print quality to suffer. The impeding of ink flow by this air bubble is called depriming.

Trapped bubbles cannot simply float away from the inkjet chip because the inkjet pen typically requires a filter screen over the inkjet chip to prevent particles in the ink from clogging the inkjet orifices. The filter screen must be placed in the inkjet cartridge near the inkjet chip to reduce the likelihood that particles will be trapped in the volume between chip and screen during manufacturing. Typically, the screen is placed at the top of a "standpipe" region in which trapped air accumulates until the air bubbles become so large that print quality suffers.

Introducing a capability to remove the trapped air bubbles from the standpipe region can thus greatly increase the service life of the inkjet cartridge before print quality begins to suffer from mechanisms other than air accumulation.

A potential solution is described in U.S. Pat. No. 4,931,811 to Cowger et al., which is also assigned to the assignee of the present invention. The ink supply of an inkjet pen is connected to the thin film printhead by way of a large diameter standpipe. The diameter of an air accumulating section of the standpipe is sufficiently great to enable ink to pass through the standpipe, despite the presence of air in the air accumulating section. Large diameter air bubbles which form in the air accumulating section are deformed by suction force from the printhead, allowing ink to pass through the standpipe between the air bubbles and the walls of the standpipe. However, once the standpipe is completely filled with an air bubble which contacts the upper surface of the silicon chip, depriming can still be expected to occur.

Depriming continues to be a main contributor to premature failures of ink cartridges. Moreover, while the solutions described in Cowger et al. may provide an improvement within ink cartridges, the approaches may not be applicable to other systems in which gas-release management is desirable.

What is needed is a gas flow control device and method which achieve gas management without requiring movable components and which may be used in such applications as selectively releasing air through an ink supply of an ink cartridge.

SUMMARY OF THE INVENTION

A gas flow control device uses capillary forces to manage gas retention and uses thermal energy to manage gas release. A capillary path has an opening within a reservoir of liquid and has a geometry by which gas flow through the path is inhibited by capillary forces on a volume of the liquid within the capillary path. An equilibrium condition is established at the interface of the liquid and gas. However, a heater is in thermal communication with the capillary path for selectively heating the liquid sufficiently to free the flow of gas through the path.

In one application, the gas flow control device is employed in an ink cartridge. The capillary path may be formed in an upright member having a resistive trace that follows the capillary path. When no current is conducted through the resistive trace, liquid enters the capillary path. Air accumulates at the lower opening of the capillary path as a result of outgassing and reverse flow from repeated firings of ink from a printhead having multiple firing chambers. An equilibrium condition is established at an ink/gas interface in the region of the lower capillary opening. The accumulated air can be released at a preselected time, such as when the ink cartridge is in a service position within a conventional inkjet printer. The air is released by conducting current through the resistive trace to overcome the capillary forces on the liquid within the capillary path. By heating the ink to a temperature above its boiling point, the surface tension on the ink goes discontinuously to zero. Heating the capillary path to drive the liquid from the path permits the air to escape.

Following a release of air, current through the resistive trace is terminated, allowing the capillary path to refill with ink. Preferably, there is a second path that ensures that the capillary path is refilled with ink following a release operation. An ink-fill maintenance path may be formed to extend from the supply of ink to a region of the capillary path above the air accumulation region, but below the upper level of the ink supply.

An optional upper mesh filter may be formed at the upper opening of the capillary path to prevent contaminants from entering the path. The resistive trace may include a serpentine section that is used to dry the filter mesh during air release operations.

As an alternative to a capillary path that is substantially vertical, the gas flow control device may be formed by two closely spaced horizontal membranes having through holes. The spacing between the membranes defines the capillary region for regulating the gas flow by means of capillary forces and thermal energy. Resistor elements may be formed within the capillary region to boil liquid within the region when gas release is desired. The through holes of the lower membrane are misaligned from the through holes of the upper membrane. The resistor elements are positioned advantageously to provide a continuous heated path between lower and upper through holes. Upon termination of a release operation, the liquid re-enters the capillary region, which is dimensioned to establish a condition in which subsequent gas flow through the device is inhibited by capillary forces. Preferably, the membranes are formed of a material that has a low thermal conductivity and a low thermal diffusivity, so that liquid at exterior surfaces of the membranes is not heated during the release operation. The membrane material should also be chemically inert with respect to the liquid (e.g., ink) with which contact is made by the membranes.

A third embodiment is similar to the second embodiment with respect to spacing apart two membranes to define a liquid path through which gas flow is to be regulated. However, in this third embodiment, only the upper membrane has a through hole. When the membranes are positioned horizontally, the gas enters laterally to reach the through hole in the upper membrane. Prior to release, capillary forces act on liquid within the through hole to inhibit escape of the gas. In a release operation, a heater is activated to apply thermal energy to the liquid within the through hole. As a result, the gas is allowed to escape. In this embodiment, the heater is a resistive element that is preferably in direct contact with the liquid within the through hole.

An advantage of the invention is that the release of air or other gas is managed without use of moving parts. Capillary forces act to inhibit gas flow, while thermal energy is selectively applied to release the accumulated gas. Thus, the addition of the control device to an inkjet cartridge does not increase the susceptibility of the cartridge to mechanical breakdown. It is believed that the heating of a capillary path to raise the temperature of ink above its boiling temperature can be achieved with five watts of power. If an upper filter screen must also be dried, it is believed that a total of only ten watts is needed to clear the capillary path and dry the filter.

DETAILED DESCRIPTION

Figure 1:
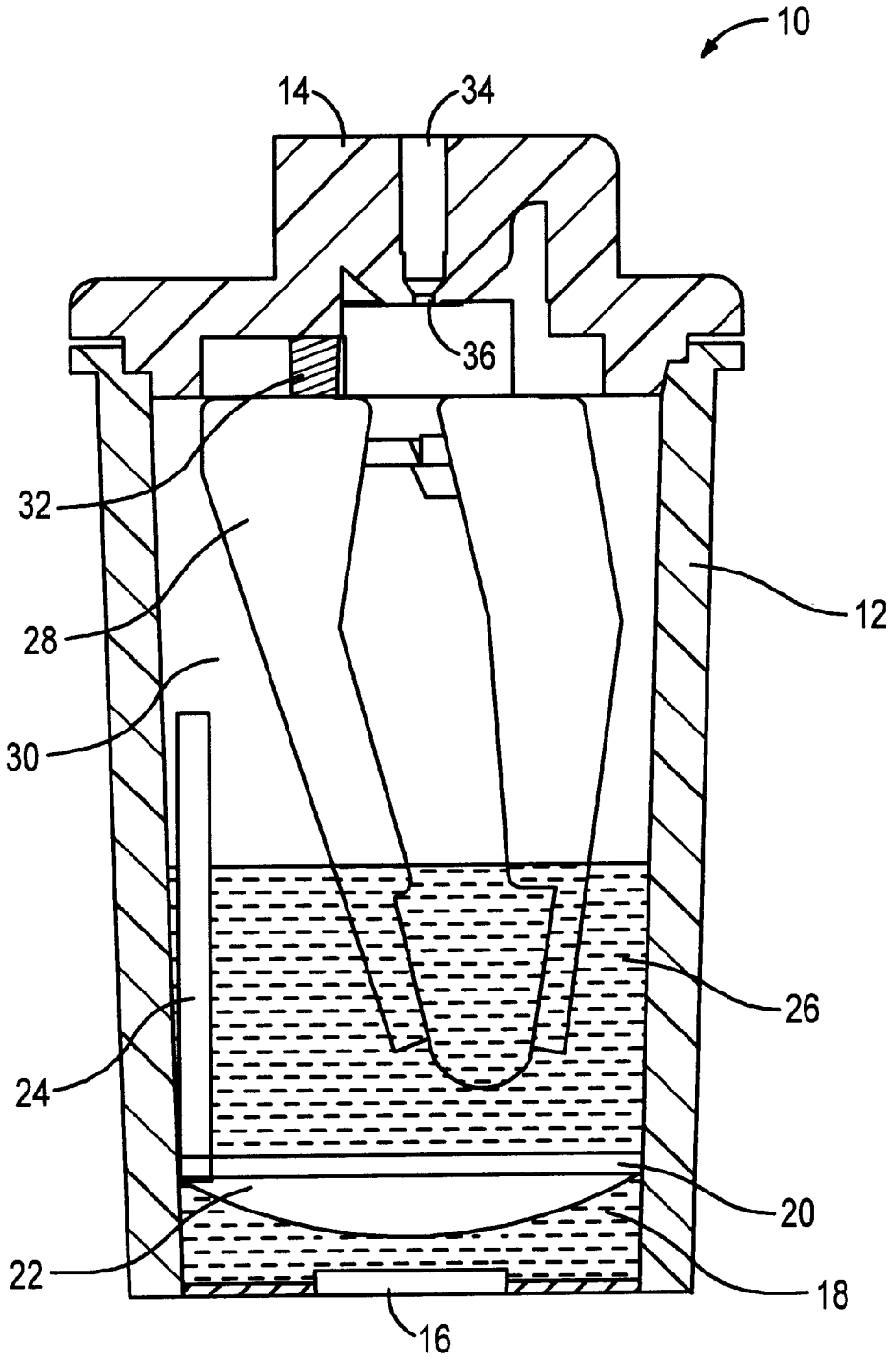
FIG. 1 is a side sectional view of an ink cartridge having a gas flow control device in accordance with the invention.

With reference to FIG. 1, an ink cartridge 10 includes a pen body 12 and a cap 14. Most of the components illustrated in the drawing are standard to ink cartridges manufactured by Hewlett-Packard Company. The cartridge includes a printhead 16 having an array of firing chambers (not shown) from which ink is projected. As is well known in the art, each firing chamber is aligned with a thin film resistor that vaporizes ink within the aligned firing chamber. When electrical current is conducted through the thin film resistor, the small volume of ink is vaporized and ejected toward a medium, such as a piece of paper.

Another conventional component is a standpipe 18 that forms a portion of an ink delivery path to the printhead 16. A wire mesh screen 20 is formed at the upper end of the standpipe. The screen may have an absolute filtration rating of 25 micrometers to serve as a stop to prevent dirt particles in the ink from being drawn down into the standpipe 18. As a result, an air accumulating section 22 is formed at the screen 20. Air bubbles entering the standpipe 18 from the printhead 16 accumulate at the screen. As will be described more fully below, a gas flow control device 24 is used to selectively release air from the air accumulating section 22. For example, air may be accumulated until the ink cartridge 10 is returned to a service position of a printer. When in the service position, a controlled release of the air is executed.

Above the wire mesh screen 20 is a reservoir 26 of ink. While the gas flow device 24 will be described with reference to the application within the ink cartridge 10, the device may be used in other applications that benefit from a controlled release of air or other gas without requiring moving components.

The illustration of FIG. 1 includes a conventional lever mechanism 28. The lever is sometimes referred to as an "accumulever." The lever extends through an air warehouse 30 to the ink reservoir 26. Another conventional component is a stop 32 that limits movement of the lever 28.

The cap 14 includes an ink supply tube 34 that extends to a valve seat 36. The ink supply tube is used to supply and replenish ink to the interior of the pen body 12 as ink is removed from the reservoir 26 during printing operations.

Figure 2:
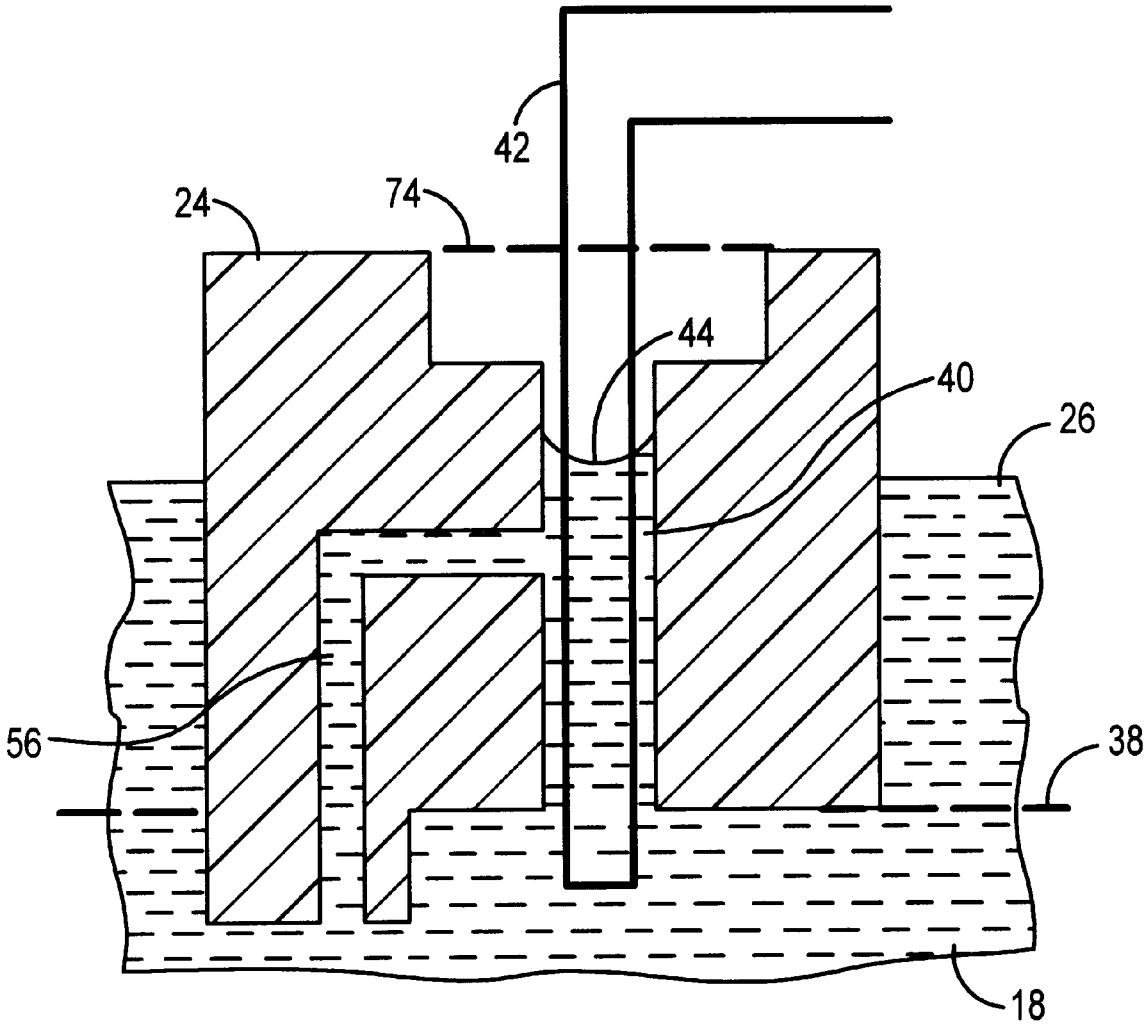
FIG. 2 is a sectional view of the flow control device prior to accumulation of air at the entrance of the device.

Referring now to FIGS. 1 and 2, the gas flow control device 24 projects above the upper level of the ink reservoir 26 and extends slightly below the plane 38 that coincides with the top of the wire mesh screen 20. That is, the lower end of the control device extends into the standpipe 18. The control device 24 includes a capillary path 40 having a small volume of ink. A resistive trace 42 extends along the length of the capillary path in thermal communication with the contained volume of ink. When electrical current is conducted through the resistive trace, the contained volume is raised to a temperature above the boiling point of ink. As a result, the capillary path is cleared of fluid. As will be described fully below, this allows any air that has accumulated at the lower opening of the capillary path 40 to escape to the air warehouse 30 of FIG. 1. However, the condition illustrated in FIG. 2 is one in which the resistive trace is deactivated and there is no air accumulated at the capillary opening.

In the operation of the printhead 16, repeated projections of ink from the firing chambers will create a negative pressure in the standpipe 18 with respect to the ink reservoir 26 above the wire mesh screen 20. However, the meniscus 44 in the capillary path 40 prevents air within the air warehouse 30 from being pulled into the standpipe 18 by the negative pressure.

Figure 3:
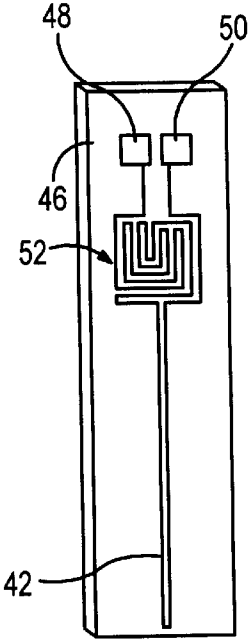

The fabrication of the gas flow control device 24 will be described with reference to FIGS. 3–7. In FIG. 3, a substrate 46 (e.g., a green ceramic substrate) has a planar surface on which the resistive trace 42 and a pair of bond pads 48 and 50 are formed. Optionally, the resistive trace includes a serpentine segment 52 that is used to dry an upper filter screen during an air release operation.

Figure 6:
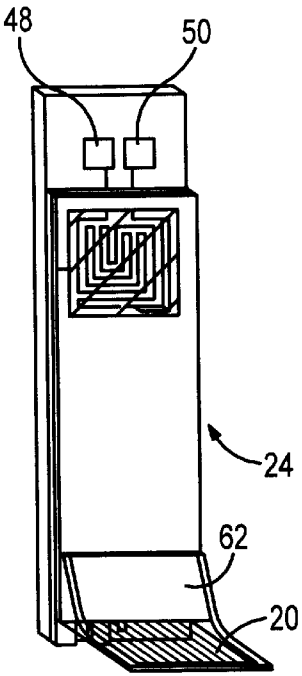
Figure 5:
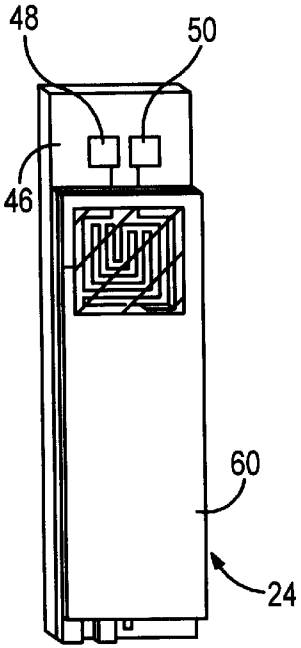
Figure 4:
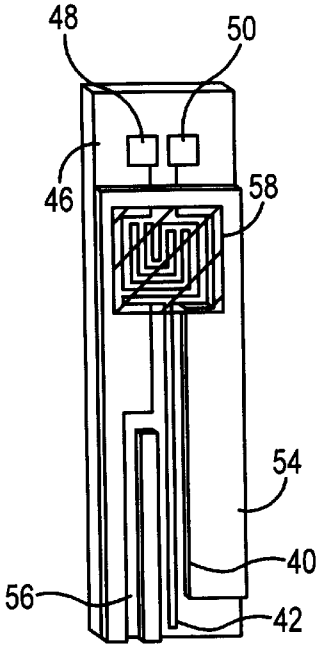

In FIG. 4, a second substrate 54 is bonded to the substrate 46. The second substrate includes a slot that defines the capillary path 40 of FIG. 2. The second substrate also includes a slot that is connected to the capillary path 40 to define an ink-fill maintenance path 56, as best seen in FIG. 2. A cutaway within the second substrate 54 of FIG. 4 is covered by the upper filter screen 58 that is to be dried by the serpentine segment 52 of the resistive trace 42. In FIG. 5, a cap 60 is placed over the second substrate and the ceramic materials are fired to form the gas flow control device 24. Optionally, the wire mesh screen 20 may be fixed to the control device by a holder 62, as shown in FIG. 6.

Figure 7:
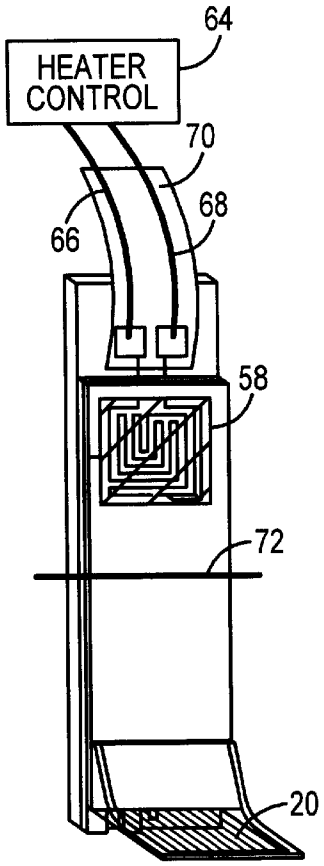
FIGS. 3–7 are respective views of steps for fabricating the device of FIGS. 1 and 2.

In FIG. 7, a heater control unit 64 is shown connected to the gas flow control device 24 by traces 66 and 68 on a flex circuit 70. The heater control unit may provide a heater drive signal when it is desirable to boil liquid within the capillary path 40 and to heat the upper filter screen 58. Approximately ten watts of power may be needed, but this requirement is likely to drop to approximately five watts if the serpentine region 52 of FIG. 3 is not added to dry the upper filter screen. The horizontal line 72 in FIG. 7 represents the ink level of the reservoir 26. On the other hand, the line 74 in FIG. 2 represents the position of the upper filter screen.

Figure 8:
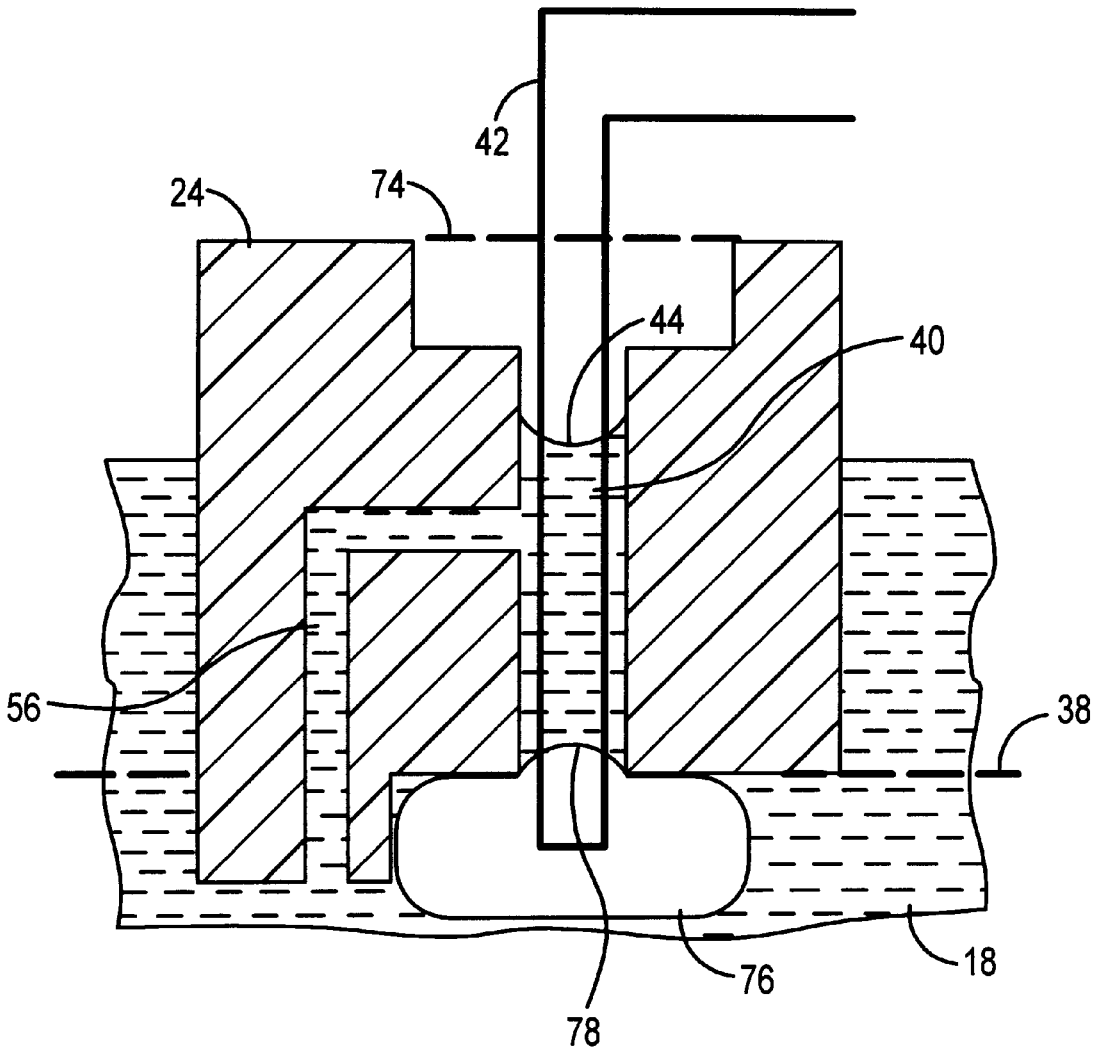
FIG. 8 is a sectional view of the device of FIG. 2 following accumulation of air.

Referring now to FIG. 8, an air bubble 76 is shown as having accumulated within the standpipe 18. As previously noted, the air is accumulated as a result of die outgassing and reverse flow of air through the printhead during multiple firings of the ink. The air bubble does not pass through the capillary path 40, since an equilibrium condition is established at the interface 78 of the air bubble with the volume of ink within the capillary path. Capillary forces act on the contained volume of ink to establish a pressure difference between the air and the liquid. This is the same physical phenomenon that prevents drooling from the firing chambers of inkjet pens. For a given gap d between two plates, the pressure difference between a gas bubble and a liquid is $\Delta P=\sigma/d$, where $\sigma$ is the surface tension of the gas/liquid interface. Ink surface tension is equal to approximately 0.018 N/m at 100 C. An acceptable cross sectional geometry of the capillary path 40 is a square for which each side has a dimension of 150 $\mu$m. Tests have been conducted with water and have indicated acceptable results for capillaries having circular cross sections with diameters in the range of 50 to 500 $\mu$m. However, the geometrical shape and dimensions will vary depending on the liquid and the gas.

The ink within the capillary path 40 is denser than the air bubble 76, so that the air bubble has a tendency to float upwardly if not restrained. It is the capillary forces within the path 40 that restrain the air bubble. The small volume of liquid within the capillary path will remain in place, unless external energy is introduced to displace the contained volume of ink. This is true even as air continues to accumulate, causing the air bubble 76 to expand within the standpipe 18.

Figure 9:
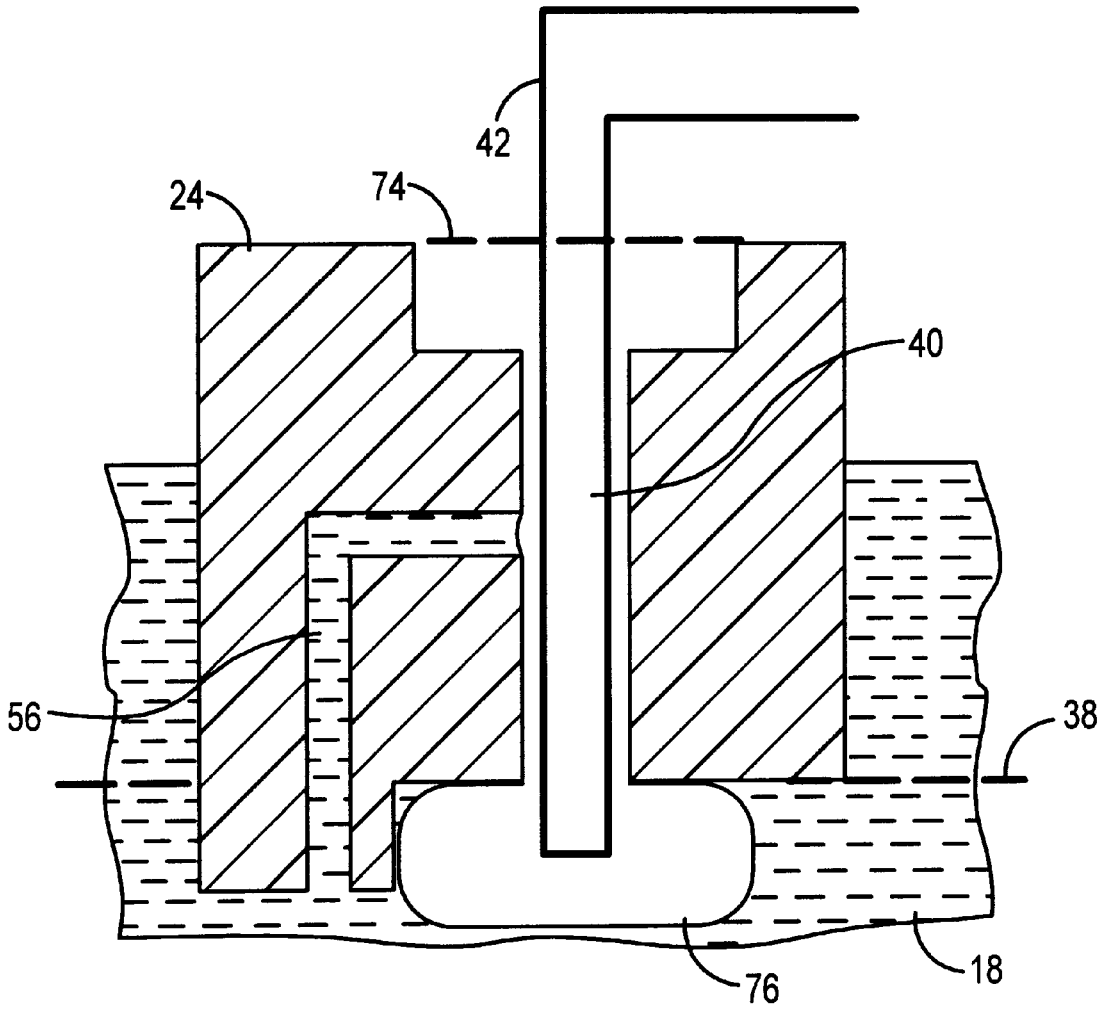
FIG. 9 is a sectional view of the device of FIG. 8 during an air-release operation.

Referring now to FIG. 9, when the cartridge is moved to a service station of a printer, current may be conducted through the resistive trace 42 to heat the capillary path 40 to a temperature above the boiling point of the ink. As the temperature is increased to above the boiling point, the surface tension of the liquid goes discontinuously to zero. As shown in FIG. 9, the capillary path has been emptied of ink, permitting an air path to extend completely through the gas flow control device 24. Since the air bubble 76 in the standpipe 18 is at a pressure that is greater than the pressure within the air warehouse at the upper opening of the capillary path, the air bubble 76 rises from the standpipe to the upper air warehouse. As previously noted, the resistive trace may include a serpentine segment 52 (shown in FIG. 3) that is used to dry the upper filter screen during the air release operation.

Gas has a low viscosity, while liquids tend to have a high viscosity. The viscosity of air is 7.1 $\mu$Pa-s at 100 C. and water has a viscosity of 281.8 $\mu$Pa-s at 100 C. This ratio of approximately 40 allows air to flow easily through channels in which liquid flows more slowly. The capillary path 40 is heated for a sufficient time to ensure that all the gas has been evacuated from the standpipe 18. Current through the resistive trace 42 is then terminated, allowing the capillary path to cool. As the path cools, the ink re-enters the capillary path, returning the control device 24 to the state shown in FIG. 2. The ink-fill maintenance path 56 is a second capillary path and is used to ensure that the air evacuation capillary path 40 remains properly wetted.

While the gas flow control device 24 of FIGS. 2–9 has been described and illustrated with reference to use in an ink cartridge, this is not critical. The process applies equally to systematically releasing other gases through other types of liquids. Thus, the device may be applied in any of a variety of gas valving applications. Moreover, it is not critical that the device remain in a vertical position. If the end of the capillary path in which air has accumulated is at a higher pressure than the opposite end of the capillary path, the gas will travel through the capillary path in the desired direction, regardless of the orientation of the capillary path.

Figure 10:
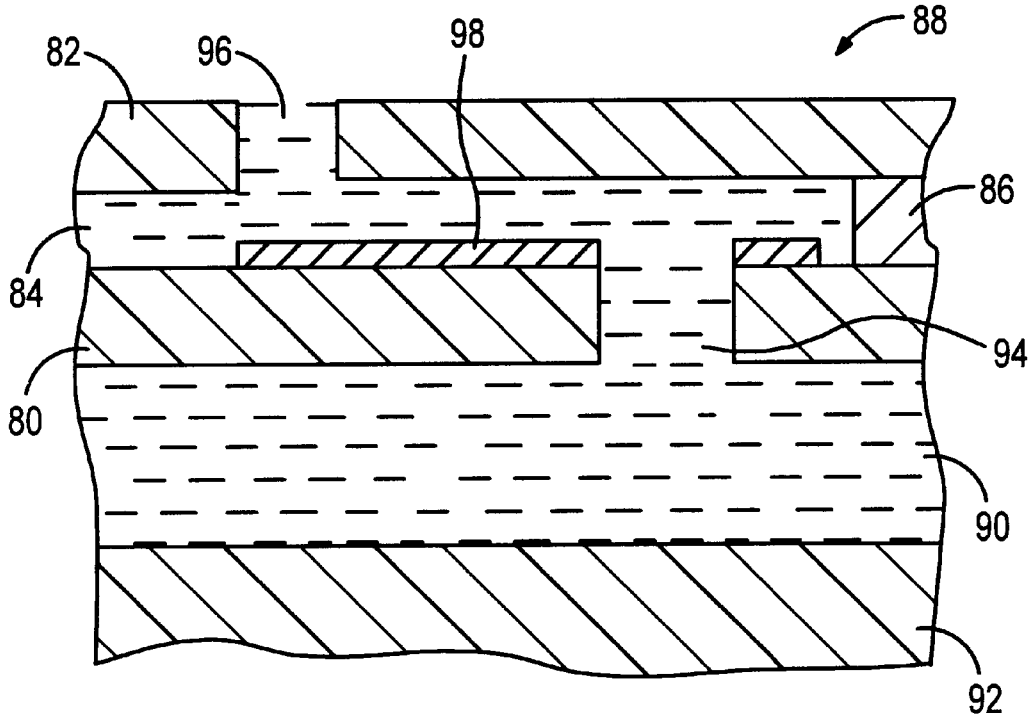
FIG. 10 is a side sectional view of a second embodiment of a gas flow control device in accordance with the invention.

A second embodiment of the gas flow control device in accordance with the invention is illustrated in FIGS. 10–13. As shown in FIG. 10, a lower polymer substrate 80 has a surface that is closely spaced from an upper substrate 82 to define a capillary path 84. The spacing may be fixed by forming standoff bumps 86 on one of the two substrates. As an example, the standoff bumps 86 may have a height of approximately 5 $\mu$m, so that the capillary path 84 will have a dimension of approximately 5 $\mu$m. However, the distance is not critical, as long as the dimensions ensure that capillary forces will establish the equilibrium condition described above with reference to the gas-to-liquid interface. The lower and upper substrates 80 and 82 are components of a gas flow control device 88 that is submerged within liquid 90 of a container 92. In one application, the container 92 is a portion of an off-axis inkjet pen, but other applications have been considered.

A through hole 94 is formed in the lower substrate 80 and a second through hole 96 is formed in the upper substrate 82. Each through hole may be square and may have a width of approximately 100 $\mu$m. However, the geometry is not critical to the invention.

Within the capillary path 84 is a heating element 98 that extends between the two through holes 94 and 96. The heating element may be screened onto one of the two substrates and connected to a heater control unit, not shown, that periodically triggers current through the heating element. Techniques for forming heating elements on a substrate are well known in the art.

Figure 11:
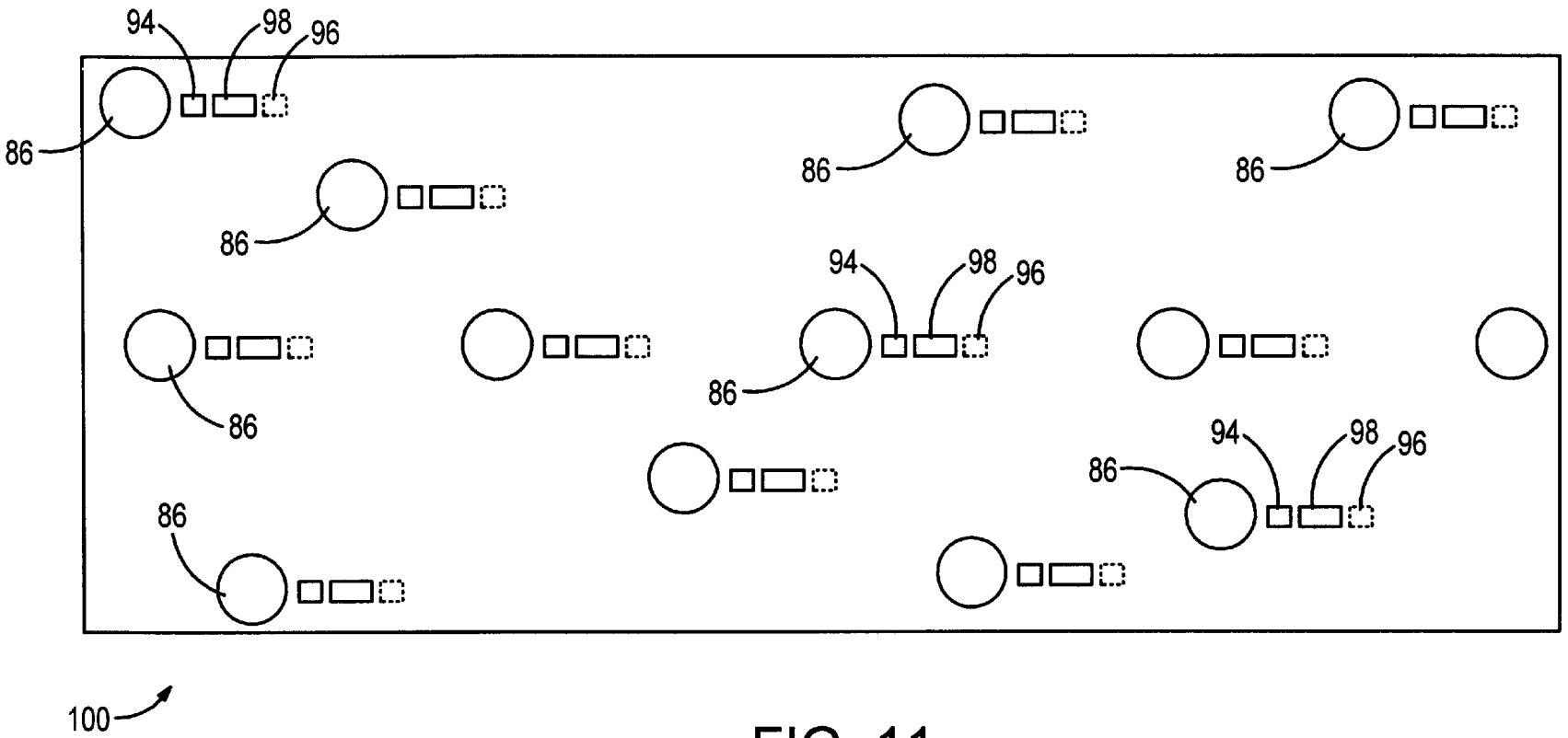
FIG. 11 is a top view of a lower membrane of the embodiment of FIG. 10.

A slightly modified embodiment of a lower substrate 100 is shown in FIG. 11. The lower substrate includes standoff bumps 86, an array of through holes 94, and a corresponding array of heating elements 98. The through holes 96 of the upper substrate are shown in phantom. The only significant difference between the lower substrate 80 of FIG. 10 and the lower substrate 100 of FIG. 11 is that the heating elements 98 have a reduced length in FIG. 11, so that there is a spacing between the heating elements and the through holes.

In each of the embodiments of FIGS. 10 and 11, the heating elements 98 are positioned to ensure that there will be a liquid-free path between the lower and upper through holes 94 and 96 when the heating elements have boiled the liquid 90 within the capillary path 84. In the embodiment of FIG. 11, there is a one-to-one correspondence between the heating elements and a pair of through holes. This is not critical to the invention. If the heating elements are sufficiently great in number or sufficiently large in area to boil all of the liquid within the spacing between the two substrates 80 and 82, the positions of the through holes can be random. However, by aligning the through holes with the heating elements, a continuous heated path between the through holes can be achieved in an efficient manner. This reduces the likelihood that extraneous heating will occur. Preferably, the substrates are formed of a material having a low thermal conductivity and a low thermal diffusivity, since activation of the heating elements 98 preferably does not heat the liquid 90 between the lower substrate 80 and the container 92.

Figure 12:
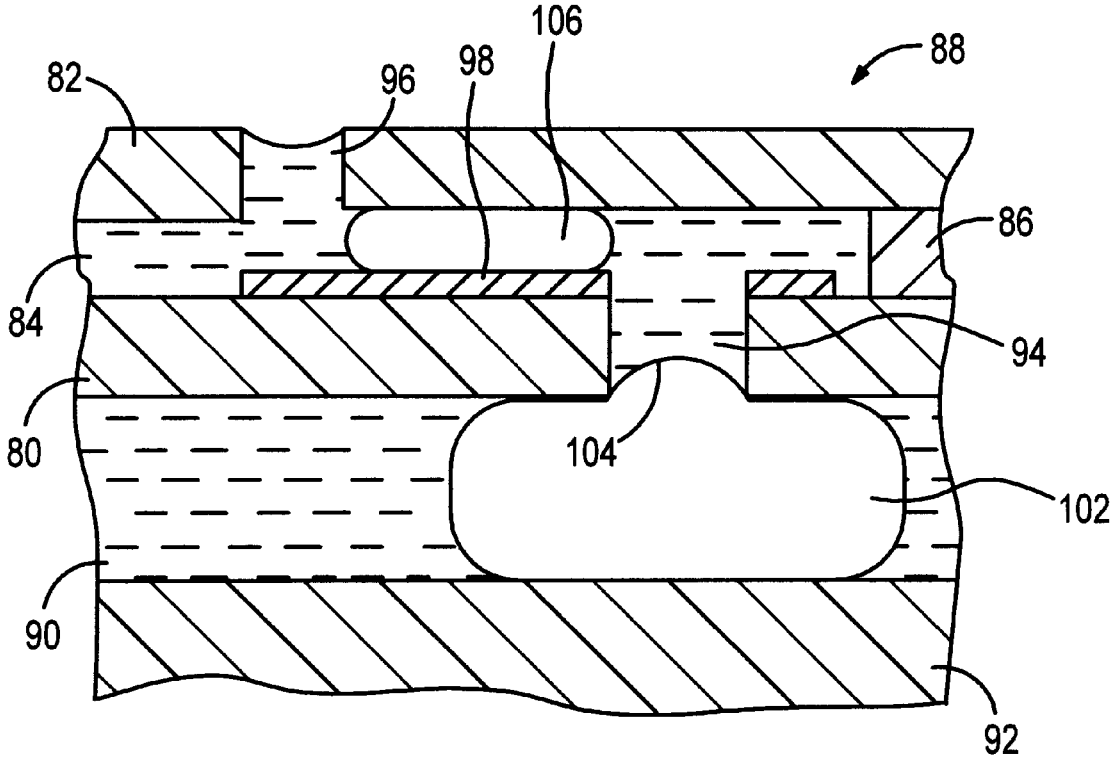
FIG. 12 is a side sectional view of the device of FIG. 10, with an accumulation of gas.
Figure 13:
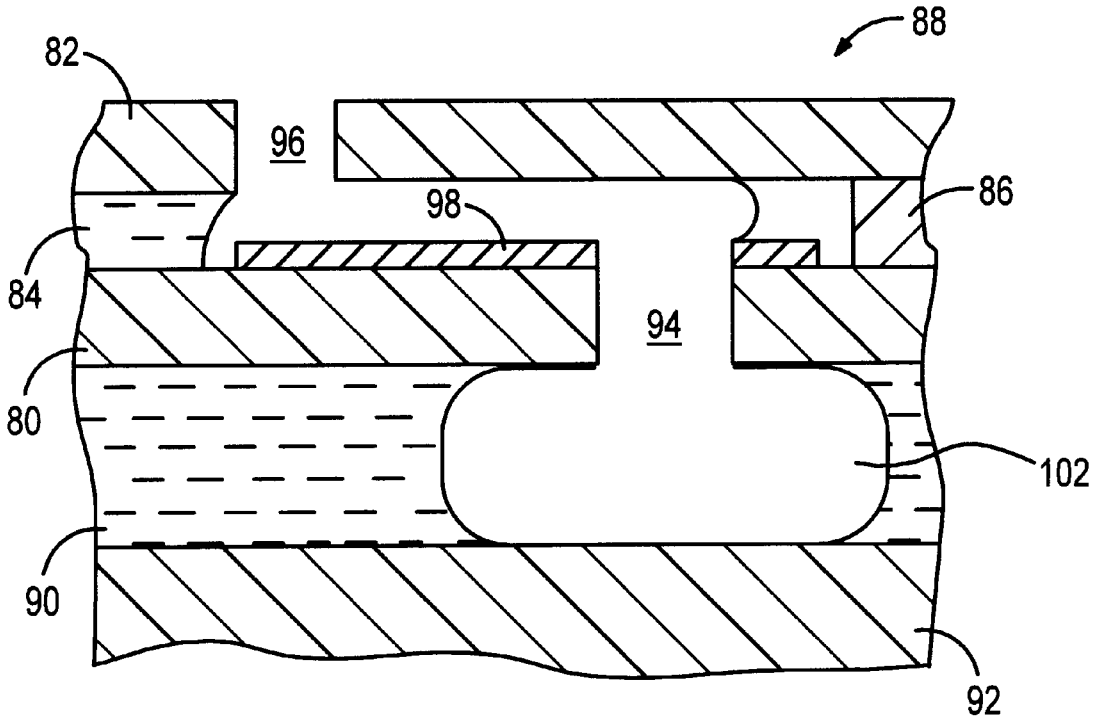
FIG. 13 is a side sectional view of the device of FIG. 12 during a gas-release operation.

With reference to FIG. 12, a gas bubble 102 is shown as having accumulated in the space between the lower membrane 80 and the container 92. However, an equilibrium condition has been established at a gas-to-liquid interface 104 because of the tendency of the higher viscosity liquid to retard flow through the capillary path 84. A second gas bubble 106 is shown atop the heating element 98. This second bubble may be a residue of a previous gas release operation. In FIG. 13, the heating element 98 has been activated and a liquid-free path has been created by boiling of the liquid within the capillary path 84. As a result, the gas bubble 102 is free to escape through the two through holes 94 and 96. After the release operation has been completed, the heating element 98 is deactivated. Optionally, a wicking layer (not shown) is formed between the two substrates to rapidly introduce liquid into the region between the two substrates when power is not applied to the heating elements 98. This optional feature increases the speed of the release-and-refill cycle, if the gas flow control device 88 is to be used in a valving application in which speed is a consideration.

Figure 14:
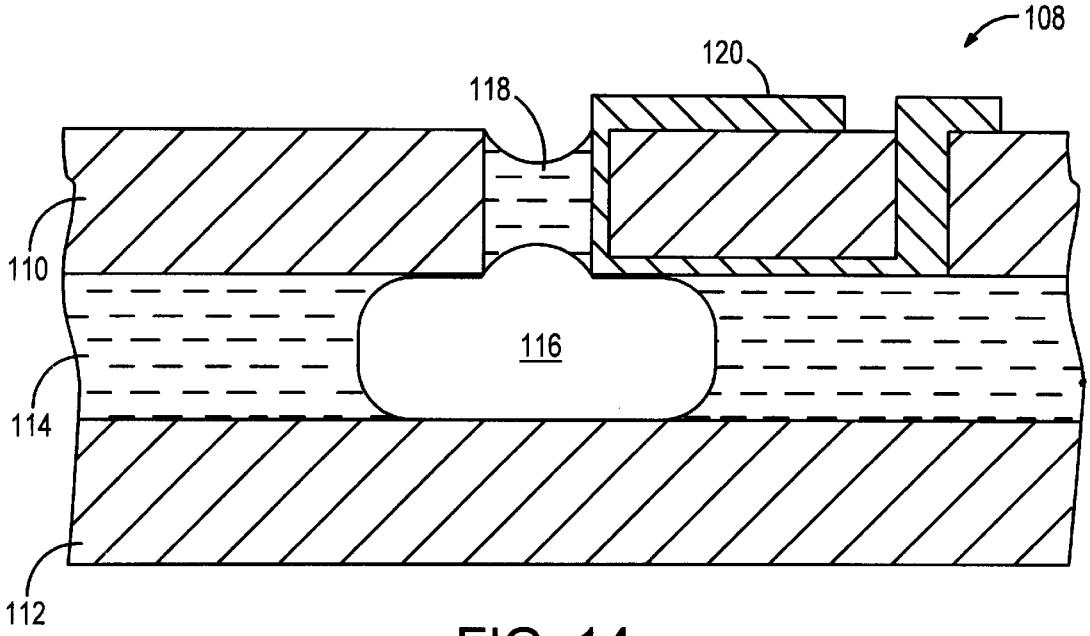
FIG. 14 is a crosssectional view of a capillary for a third embodiment of a gas flow control device in accordance with the invention, with the device including an accumulation of gas.
Figure 15:
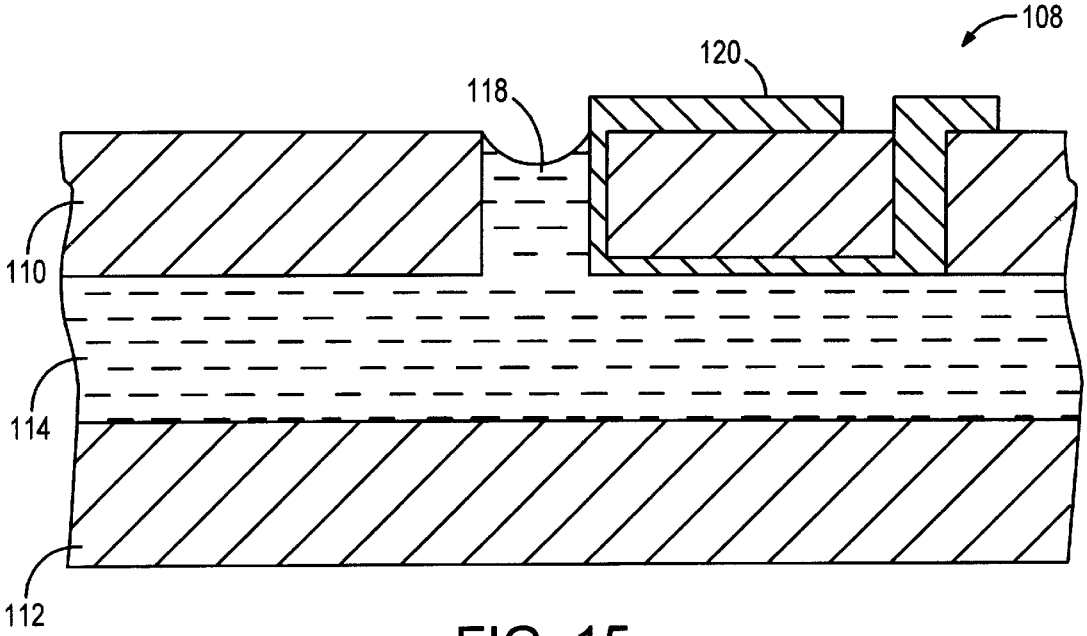
FIG. 15 is a crosssectional view of the device of FIG. 14 following a gas-release operation.

Referring now to FIGS. 14 and 15, a crosssectional view of a capillary for a third embodiment of a gas flow control device 108 is shown as including an upper substrate 110 and a lower substrate 112. The substrates are spaced apart by a small distance to define a liquid-containing path 114. However, in the condition of FIG. 14, the liquid-containing path includes a volume of gas 116. The gas is effectively trapped within the path by capillary forces exerted on a small volume of liquid within a through hole 118 in the upper substrate 110.

The volume of gas 116 will remain within the path until a heater 120 is activated. The thermal energy from the heater 120 is transferred to the small volume of liquid within the through hole 118. A sufficient amount of thermal energy is generated to cause the liquid in the through hole to release the gas 116. Following this release operation, the control device 108 is in the gas-free condition shown in FIG. 15.

The most significant difference between the third embodiment of FIGS. 14 and 15 and the previously described embodiments is that the heater 120 extends along one wall of a vertical through hole that contains the volume of fluid on which the capillary forces are acting. That is, the heater is in direct contact with the liquid that is being removed from the vertical opening. This modification is relatively small with regard to structure, but may provide significant improvements in some applications of devices that require gas flow control.

What is claimed is:

1. A gas flow control device comprising:

a reservoir of liquid;

a capillary conduit at least partially submerged within said reservoir, said capillary conduit having a first opening within said reservoir and having cross sectional dimensions such that gas flow through said capillary conduit is inhibited by capillary forces on said liquid within said capillary conduit; and at least one heater in thermal communication with said capillary conduit for selectively generating thermal energy to heat said liquid within said capillary conduit sufficiently to enable gas flow through said capillary conduit.

2. The device of claim 1 further comprising a fluid maintenance conduit from a lower portion of said reservoir to said capillary conduit at a submerged level below an upper level of said liquid of said reservoir, thereby enabling refill of said capillary conduit after each application of heat to said liquid.

3. The device of claim 1 further comprising a means for attaching said gas flow control device to an inkjet cartridge, wherein said reservoir of liquid is a storage of ink of said inkjet cartridge.

4. The device of claim 3 further comprising a filter screen submerged in said reservoir at a level proximate to said first opening of said capillary conduit.

5. The device of claim 3 wherein said capillary conduit has a second opening above an upper level of said ink.

6. The device of claim 1 wherein said heater includes a trace having a resistivity such that heat is generated in response to conduction of current along said trace.

7. The device of claim 6 wherein said heater is connected to a controller for selectively energizing said trace.

8. The device of claim 1 wherein said capillary conduit is comprised of first and second substrates that are spaced apart to define a capillary path, said heater including at least one heat generating member in a region between said first and second substrates, each of said first and second substrates including at least one hole proximate to one of said heat generating members.

9. The device of claim 8 wherein said first substrate includes a plurality of first holes and said second substrate includes a plurality of second holes that are misaligned with said first holes, each of said first and second holes being proximate to a specific said heat generating member.

10. The device of claim 1 wherein said capillary conduit is comprised of upper and lower substrates that are spaced apart to define a liquid-containing path, said upper substrate having a through hole extending to said liquid-containing path, said heater being along said through hole, said through hole being dimensioned to promote capillary force retention of a volume of said liquid within said through hole when said heater is deactivated.

11. A method of controlling gas flow within a device comprising steps of:

forming a capillary path within said device;

suspending said device in a reservoir containing a liquid such that said capillary path has a first end and a second end and at least said first end is submerged in said liquid, said capillary path having sufficiently small dimensions such that gas flow through said capillary path to said second end is inhibited by capillary forces at a gas-to-liquid interface along said capillary path; and selectively heating said liquid within said capillary path to a temperature at which said gas flow through said capillary path to said second end is enabled.

12. The method of claim 11 wherein said step of selectively heating said liquid includes raising said temperature to at least a boiling temperature of said liquid.

13. The method of claim 11 wherein said reservoir containing said liquid is a reservoir of ink of an inkjet cartridge.

14. The method of claim 11 further comprising forming a liquid-fill maintenance path within said device such that said maintenance path extends to an intermediate region of said capillary path from a level below said intermediate region and below an uppermost level of said liquid.

15. An ink cartridge comprising:

a pen body;

a supply of liquid ink contained within said pen body;

a firing mechanism in ink-transfer engagement with said supply for selectively projecting said liquid ink from said pen body; and a gas-release controller for selectively releasing gas from said supply of liquid ink, said gas-release controller including a narrow passageway in communication with said supply of liquid ink, said passageway being dimensioned such that an equilibrium condition is established at an interface of said liquid ink with a gas bubble having a position below an uppermost level of said liquid ink, said gas-release controller further having at least one heater positioned with respect to said passageway to selectively vary thermal dynamics within said passageway such that in an absence of solidifying said liquid ink, said equilibrium condition is overcome and said gas bubble is freed to pass through said passageway.

16. The ink cartridge of claim 15 wherein said pen body and said gas-release controller define a gas accumulation region at said position of said bubble, said passageway having a vertical component of direction and having a lower opening at said gas accumulation region.

17. The ink cartridge of claim 15 wherein said heater is a resistive trace in thermal communication with said passageway.

18. The ink cartridge of claim 17 further comprising a filter at an upper extent of said passageway, said resistive trace having a serpentine region proximate to said filter for drying said filter and having a second portion that extends along said passageway.

19. The ink cartridge of claim 17 wherein said gas-release controller further includes an ink-fill maintenance path through said upright structure from said supply to said capillary path at a level above said position of said gas bubble.

20. The ink cartridge of claim 15 wherein said gas-release controller includes an upright structure with mat least one capillary path in which said equilibrium condition is established by capillary forces.

21. The ink cartridge of claim 15 wherein said gas-release controller includes a pair of horizontal membranes closely spaced apart to define a capillary path for establishing said equilibrium condition, each said membrane having vertical holes extending therethrough.

* * * * *